US005987656A

United States Patent [19]

Kakutani

[11] Patent Number: 5,987,656

[45] Date of Patent: Nov. 23, 1999

[54] TOILET SEAT COVER

[75] Inventor: Masayoshi Kakutani, Kainan, Japan

[73] Assignee: MAC Sanko Co., Ltd., Wakayama, Japan

[21] Appl. No.: 08/201,479

[22] Filed: Feb. 23, 1994

Related U.S. Application Data

[63] Continuation of application No. 07/915,419, Jul. 17, 1992, abandoned.

[30] Foreign Application Priority Data

Jul. 19, 1991 [JP] Japan ..... 3-064675
Mar. 5, 1992 [JP] Japan ..... 4-011162

[51] Int. Cl.[6] ..... A47K 13/14

[52] U.S. Cl. ..... 4/245.3

[58] Field of Search ..... 4/245.4, 245.6, 4/245.3; 156/87; 428/316.6; 525/57

[56] References Cited

U.S. PATENT DOCUMENTS

| | | | |
|---|---|---|---|
| 3,348,243 | 10/1967 | Kelly | 4/245.4 |
| 3,579,669 | 5/1971 | Loewenstein | 4/245.4 |
| 3,911,053 | 10/1975 | Wiest et al. | 525/57 X |
| 4,284,275 | 8/1981 | Fletcher | 428/37 X |
| 4,589,149 | 5/1986 | Bassi | 4/245.6 |

FOREIGN PATENT DOCUMENTS

| | | | |
|---|---|---|---|
| 2625669 | 7/1989 | France | 4/245.4 |
| 892 232 | 10/1953 | Germany . | |
| 53 864 | 11/1967 | Germany . | |
| 2531269 | 5/1977 | Germany | 4/245.3 |
| 3906796 | 9/1990 | Germany | 4/245.4 |
| 63-140294 | 9/1988 | Japan . | |
| 63-144098 | 9/1988 | Japan . | |
| 88 01 844 | 3/1988 | WIPO . | |

*Primary Examiner*—Robert M. Fetsuga
*Attorney, Agent, or Firm*—Darby & Darby

[57] ABSTRACT

A toilet seat cover for a toilet seat including a sheet made of unwoven fabric having a shape corresponding to a shape of an upper surface of the toilet seat, and a mount layer including synthetic resin emulsion and applied to one surface of the sheet. Upon placing and pressing slightly the toilet seat cover against the toilet seat, air in pores formed in the mount layer is discharged, thereby reducing pressure in the pores. Accordingly, the toilet seat cover can be easily attached to the toilet seat due to the vacuum suction force. Further, the toilet seat cover can be easily detached from the toilet seat by peeling the mount layer therefrom, leaving nothing on the toilet seat. The sheet has a laminated structure including a fabric layer, a porous buffer layer which provides comfortable seating and good heat insulation effect, and a permeation inhibitor layer for inhibiting material of the mount layer from permeating the porous buffer layer.

16 Claims, 14 Drawing Sheets

TOILET SEAT COVER

This is a continuation of application Ser. No. 07/915,419, filed Jul. 17, 1992, abandoned.

BACKGROUND OF THE INVENTION

1. Field of the Invention

This invention relates to a toilet seat cover attachable to a toilet seat.

2. Description of Related Art

As a toilet seat cover for a U-shaped toilet seat of the Western type, there has been known the one whose schematic plan view is shown in FIG. 1 (Japanese Utility Mode Application Laid-Open No. 63-140294). This toilet seat cover is in the general form of a pair of trousers. In FIG. 1, indicated at 31, 32 are leg portions, at 33 a waist portion, at 34 an elastic annular portion, and at 35 a reinforced edge portion. The cylindrical leg portions 31, 32 are spaced apart by a specified distance and configured into shape of the toilet seat respectively. Leading ends of the leg portions 31, 32 are shunt-woven slightly round, and base ends thereof are formed continuously to the waist portion 33 configured into a cylindrical form bigger than the leg portions 31, 32. The waist portion 33 is formed to the elastic annular portion 34 having a greater elasticity than the waist portion 33. Further, the reinforced edge portion 35 is formed over an entire peripheral portion of the elastic annular portion 34. This toilet seat cover is fitted to the toilet seat from the reinforced edge portion 35, and leading ends of the toilet seat are fitted respectively to the leading ends of the leg portions 31, 32. The reinforced edge portion 35 is moved up to a pivot portion of the toilet seat. In this way, the toilet seat cover is completely fitted to the toilet seat. However, the toilet seat cover has suffered the problem that it is cumbersome to take it off the toilet seat for washing and fit it to the toilet seat again since the elastic annular portion 34 has a high degree of elasticity.

As a toilet seat cover for an O-shaped toilet seat of the Western type, there has been known the one whose rear view is shown in FIG. 2. In FIG. 2, indicated at 91 is a seat cover main body formed of a cylindrically woven stretchable fabric. One circumferential end of the main body 91 is turned up, and thereby forming a cylindrical frame core inserting portion 92. In the inserting portion 92 is inserted a frame core 94 which is slightly longer than an inner circumferential end of the toilet seat. The other circumferential end of the main body 91 is also turned up, and thereby forming a cylindrical elastic member inserting portion 93. In the inserting portion 93 is inserted an elastic member 95 such as an elastic braid.

Opposite ends of the elastic member 95 are pulled outside in specified positions from a circumferential direction of the elastic member inserting portion 93. S-shaped hooks 96, 96 are mounted to the opposite ends of the elastic member 95. In the case where thus formed toilet seat cover is fitted to the O-shaped toilet seat, a rear surface of the seat cover main body 91 is attached to an underside of the toilet seat in such a manner as to put the frame core inserting portion 92 along the inner circumferential end of the toilet seat. Next, the elastic member inserting portion 93 provided at the other circumferential end of the main body 91 is pulled upward through an opening defined by the toilet seat. Then, the main body 91 is expanded outside while pulling the inserting portion 93, and the inserting portion 93 is pulled downward from the outer circumferential end of the toilet seat. Consequently, the S-shaped hooks 96, 96 are engaged with each other behind the pivot portions of the toilet seat. However, this toilet seat cover is also cumbersome since the frame core 94 needs to be taken out when it is to be washed.

In view of the above problems, there has been proposed a toilet seat cover as shown in FIGS. 3 and 4 (Japanese Utility Model Application Laid-Open No. 63-144098). FIG. 3 is a plan view showing a toilet seat and surface fasteners, and FIG. 4 is a rear view showing a seat cover main body. In FIG. 3, indicated at 21 is a toilet seat. A plurality of surface fasteners 22 in the form of a strip are adhered to an upper surface of the toilet seat 21 longitudinally along a circumferential direction thereof.

In FIG. 4, indicated at 23 is a seat cover main body made of desired material. The main body 23 is configured identically to the shape of the upper surface of the toilet seat 21, and has surface fasteners 24 sewn to a rear surface thereof so as to oppose the surface fasteners 22 adhered to the toilet seat 21. The seat cover main body 23 is attached to the toilet seat 21 by attaching the corresponding surface fasteners 22, 24. This seat cover main body 23 is easily attachable to and detachable from the toilet seat 21. However, in the case where the main body 23 is detached for washing or other purposes, the surface fasteners 22, remaining upon the upper surface of the toilet seat 21, are liable to be dirtied or damaged. In addition, it is uncomfortable for one to sit upon the toilet seat having the surface fasteners 22 when the main body 23 is detached.

SUMMARY OF THE INVENTION

It is an object of the invention to provide a toilet seat cover which can be easily attached to and detached from a toilet seat.

It is another object of the invention to provide a toilet seat cover which leaves nothing on a toilet seat when detached therefrom.

It is still another object of the invention to provide a toilet seat cover which gives excellent seating and high heat insulation effect.

It is further another object of the invention to provide a toilet seat cover which has less deterioration of physical properties and can be used repeatedly by washing in the case where it is smudged.

A toilet seat cover in accordance with the invention comprises a sheet having a shape corresponding to a shape of an upper surface of a toilet seat, and a mount layer including synthetic resin and applied to one surface of the sheet. Upon slightly pressing the toilet seat cover against the toilet seat, the mount layer applied to a rear surface of the sheet is easily attached to the toilet seat and the toilet seat cover is fixed thereto without moving due to the vacuum suction force. Accordingly, the toilet seat cover remains attached even when the toilet seat is held upright. Further, this toilet seat cover can be easily detached from the toilet seat by peeling it therefrom, leaving nothing on the toilet seat. Moreover, since this toilet seat cover requires no attachment member on the toilet seat, one can seat on the toilet seat without being uncomfortable when the cover is detached.

The seat of the toilet seat cover may also include a porous buffer layer. By the presence of the porous buffer layer, comfortable seating and higher heat insulation effect are obtainable. Further, a permeation inhibitor layer may be provided between the porous buffer layer and mount layer, thereby effectively inhibiting material of the mount layer from permeating pores in the porous buffer layer.

The material of the mount layer includes a composition of urethane synthetic resin, foaming agent, surface active agent, assistance, and the like. It may be possible to use a mixture of ethylene vinyl acetate alcohol and ethylene methyl acrylate (weight percentage of ethylene vinyl acetate alcohol is 50 to 80%).

The above and further objects and features of the invention will more fully be apparent from the following detailed description with accompanying drawings.

DESCRIPTION OF THE PREFERRED EMBODIMENTS

Hereafter, the present invention will be described in detail with reference to the drawings showing embodiments thereof.

First Embodiment

Figure 1:
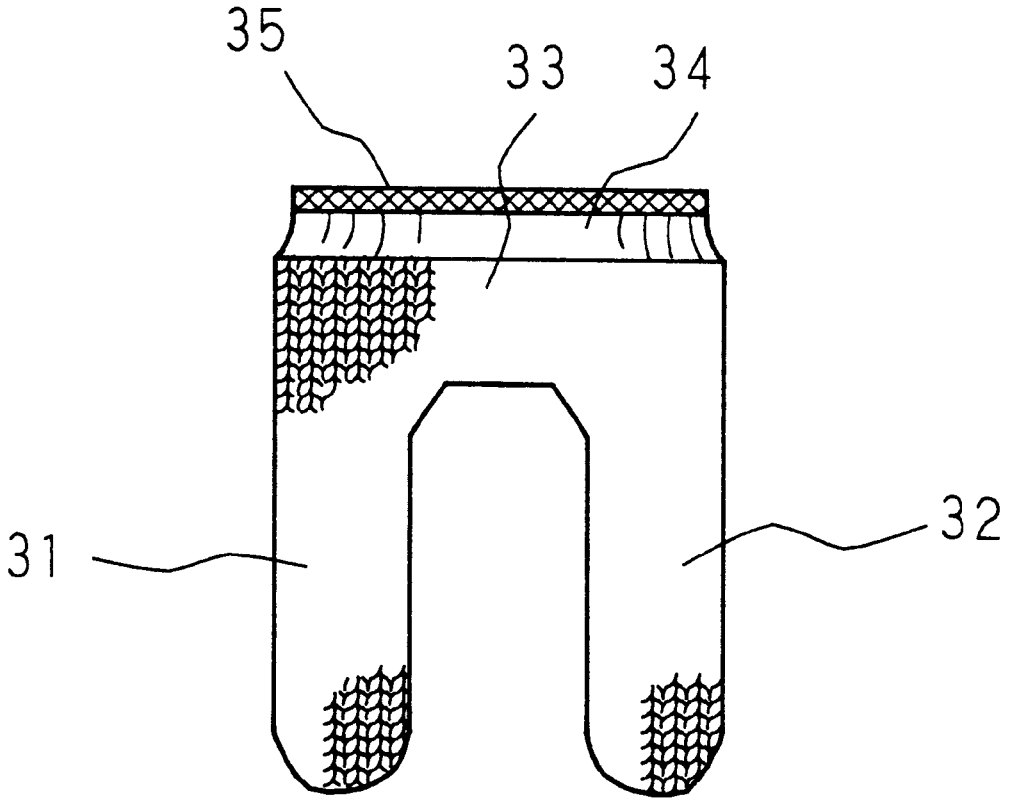
Fig. 1 Prior Art
FIG. 1 is a schematic plan view of a toilet seat cover of the prior art.
Figure 2:
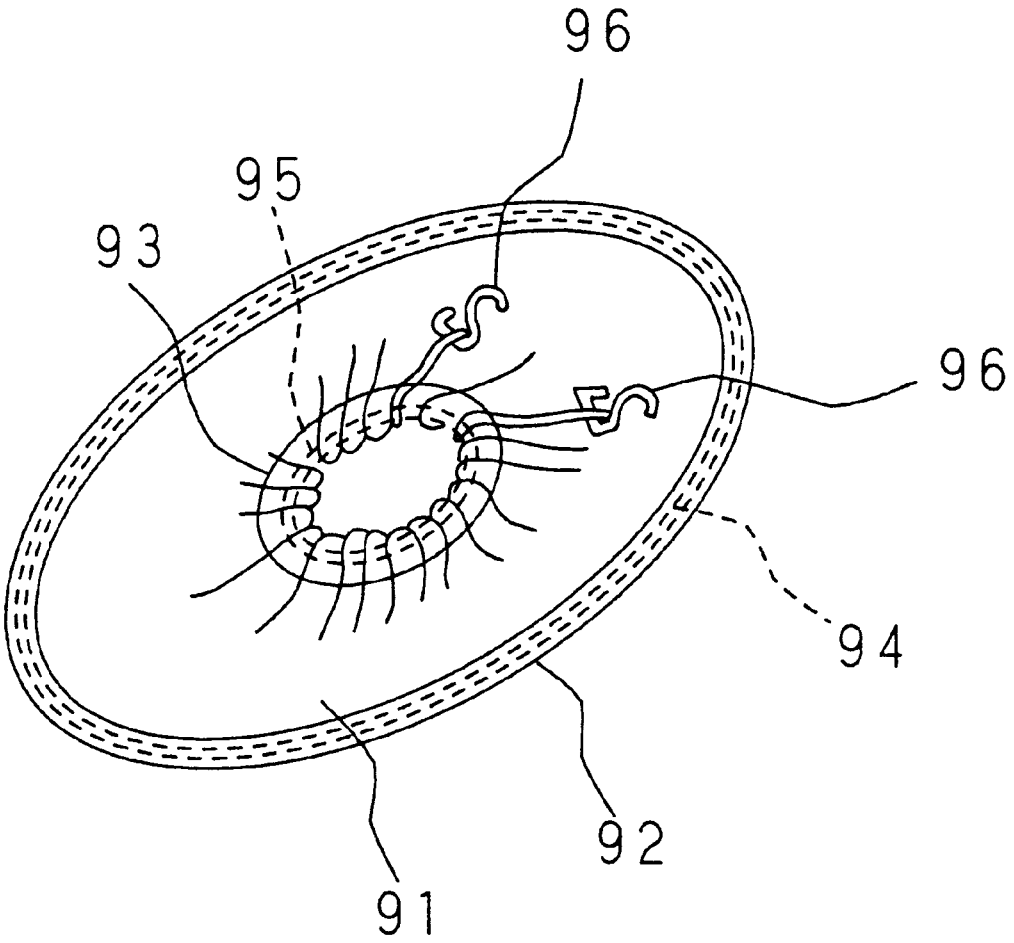
Fig. 2 Prior Art
FIG. 2 is a rear view of another toilet seat cover of the prior art.
Figure 3:
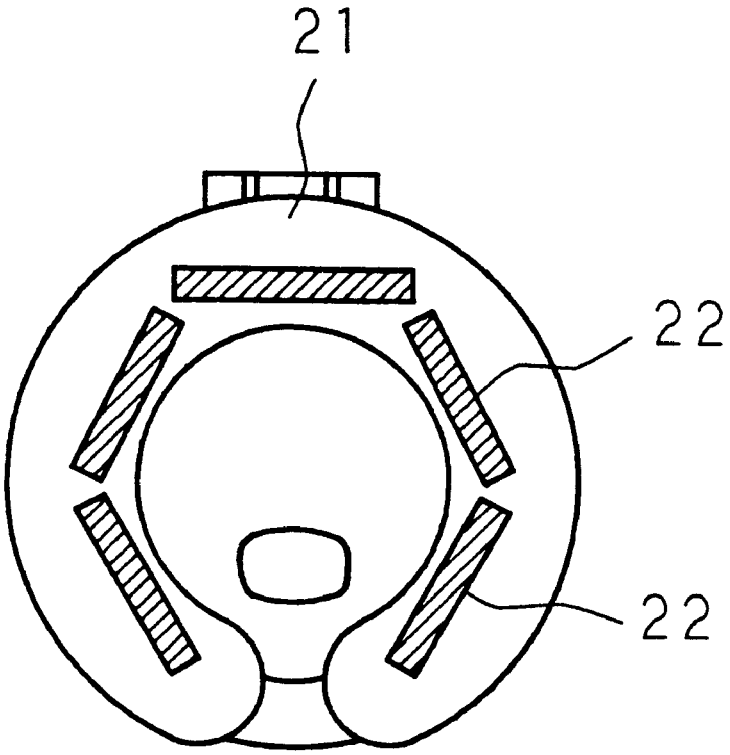
Fig. 3 Prior Art
FIG. 3 is a plan view showing a prior art toilet seat provided with surface fasteners to which still another toilet seat cover of prior art is mounted.
Figure 4:
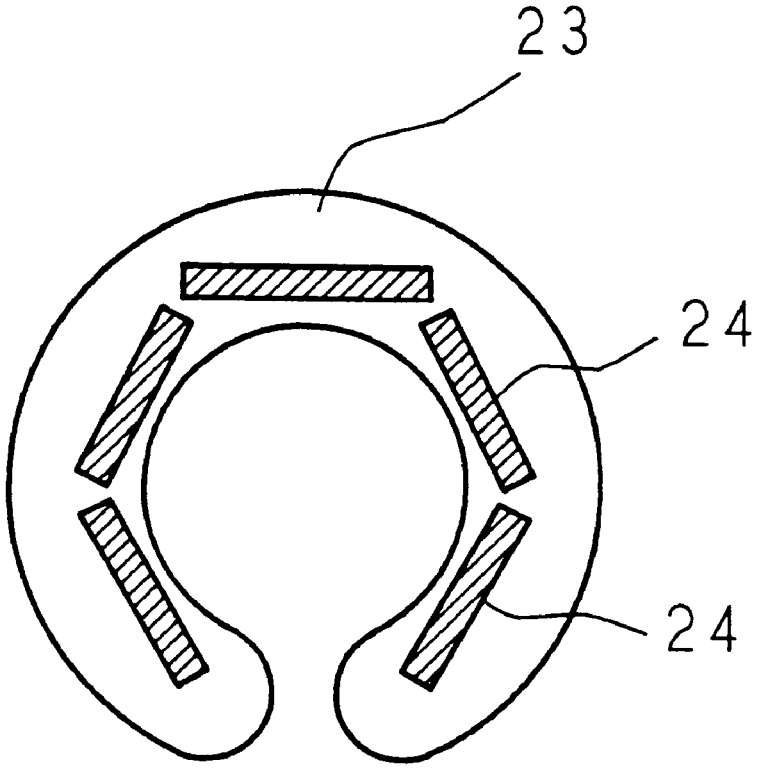
Fig. 4 Prior Art
FIG. 4 is a rear view showing the still another prior art toilet seat cover.
Figure 5:
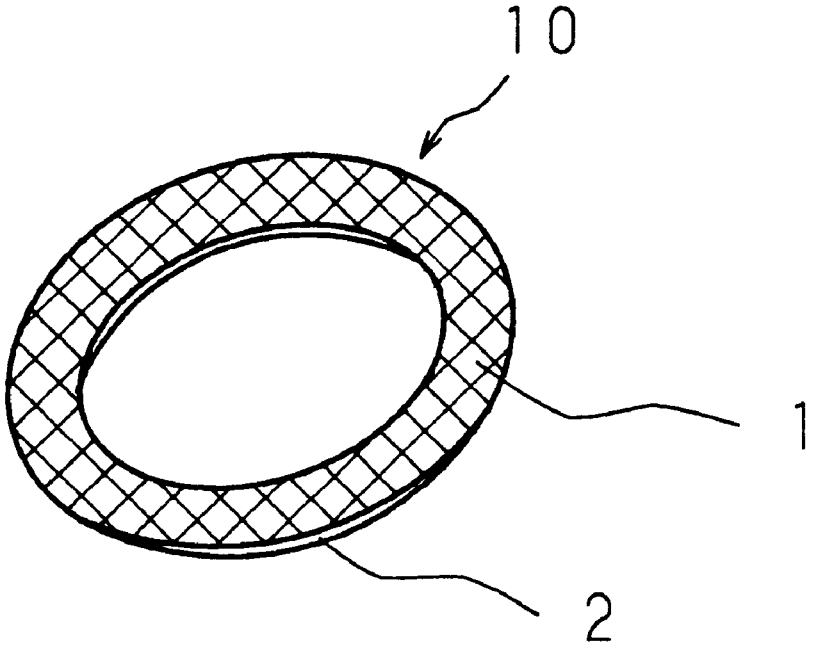
FIG. 5 is a perspective view of a toilet seat cover as a first embodiment of the invention.
Figure 6:
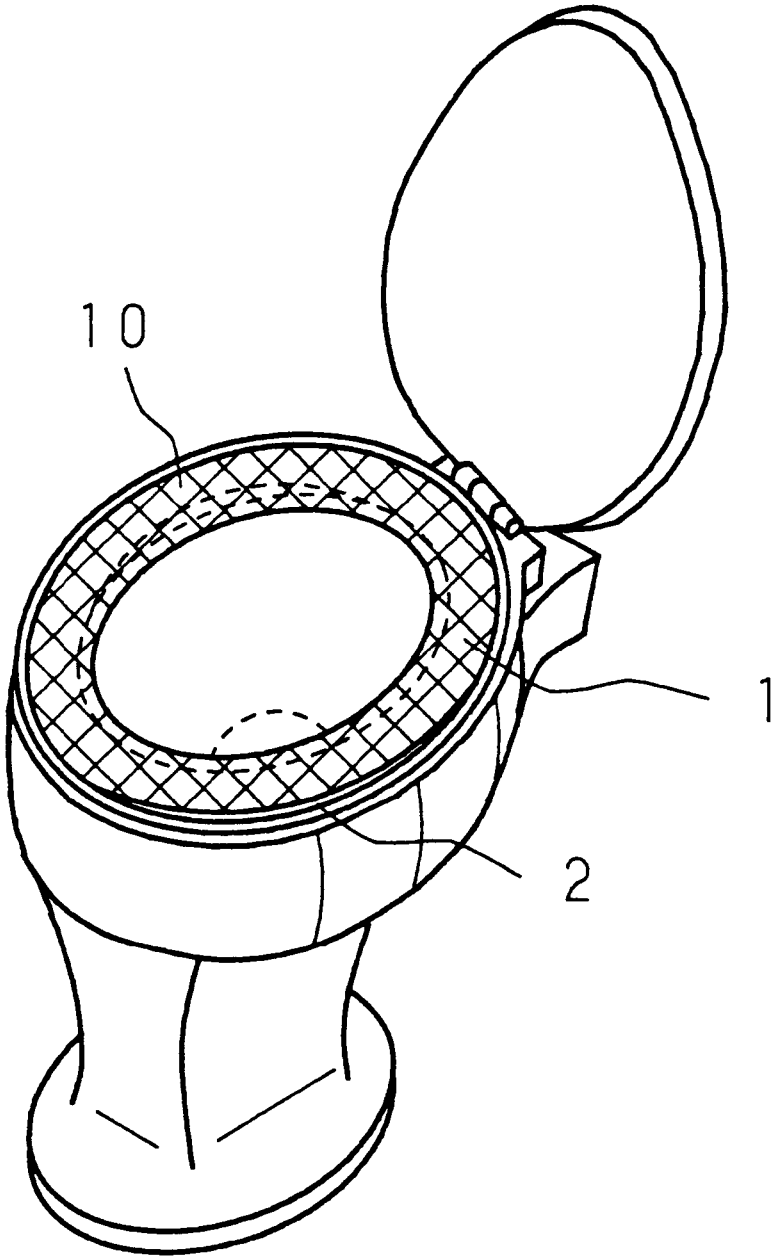
FIG. 6 is a perspective view showing an attached state of the toilet seat cover of the first embodiment.

FIG. 5 is a perspective view showing a toilet seat cover 10 of a first embodiment of the invention, and FIG. 6 is a perspective view showing an attached state of the toilet seat cover 10. In these figures, indicated at 1 is a sheet made of unwoven fabric configured substantially identically to the shape of an upper surface of an O-shaped toilet seat. To a rear surface of the sheet 1 is applied a mount layer 2 obtained by mixing components shown in TABLE-1 below.

TABLE 1

| COMPONENT | WEIGHT PART |
|---|---|
| SYNTHETIC RESIN EMULSION | 100 |
| FOAMING AGENT | 10 |
| SURFACE ACTIVE AGENT | 3 |
| ASSISTANT (1) | 1 |
| ASSISTANT (2) | 2 |
| ASSISTANT (3) | 0.5 |
| CATALYST | 1 |

In this embodiment, the followings were used as materials for the mount layer 2. Urethane product"DICFOAM F-520" was used as synthetic resin (emulsion state) serving as a main component; "F-1" was used as foaming agent;"CMC" of 4% concentration was used as surface active agent;"VONCOAT 3750" was used as assistant (1);"CR-5L" was used as assistant (2);"VONDIC NBA-1" was used as assistant (3); and "CATALYST PA-202 " was used as catalyst."CMC" is manufactured by Dai-ichi Kogyo Seiyaku Co., Ltd. Other products are manufactured by Dainippon Ink and Chemicals Inc.

As an adhering mechanism of the mount layer 2 made of these materials to the toilet seat, the vacuum suction force acts due to numerous pores formed in the mount layer 2. More specifically, when the mount layer 2 is slightly pressed against the toilet seat, the air in the pores is discharged, thereby reducing the pressure in the pores. Consequently, the toilet seat cover 10 (the mount layer 2) is adhered to the toilet seat due to the vacuum suction force.

Figure 5A:
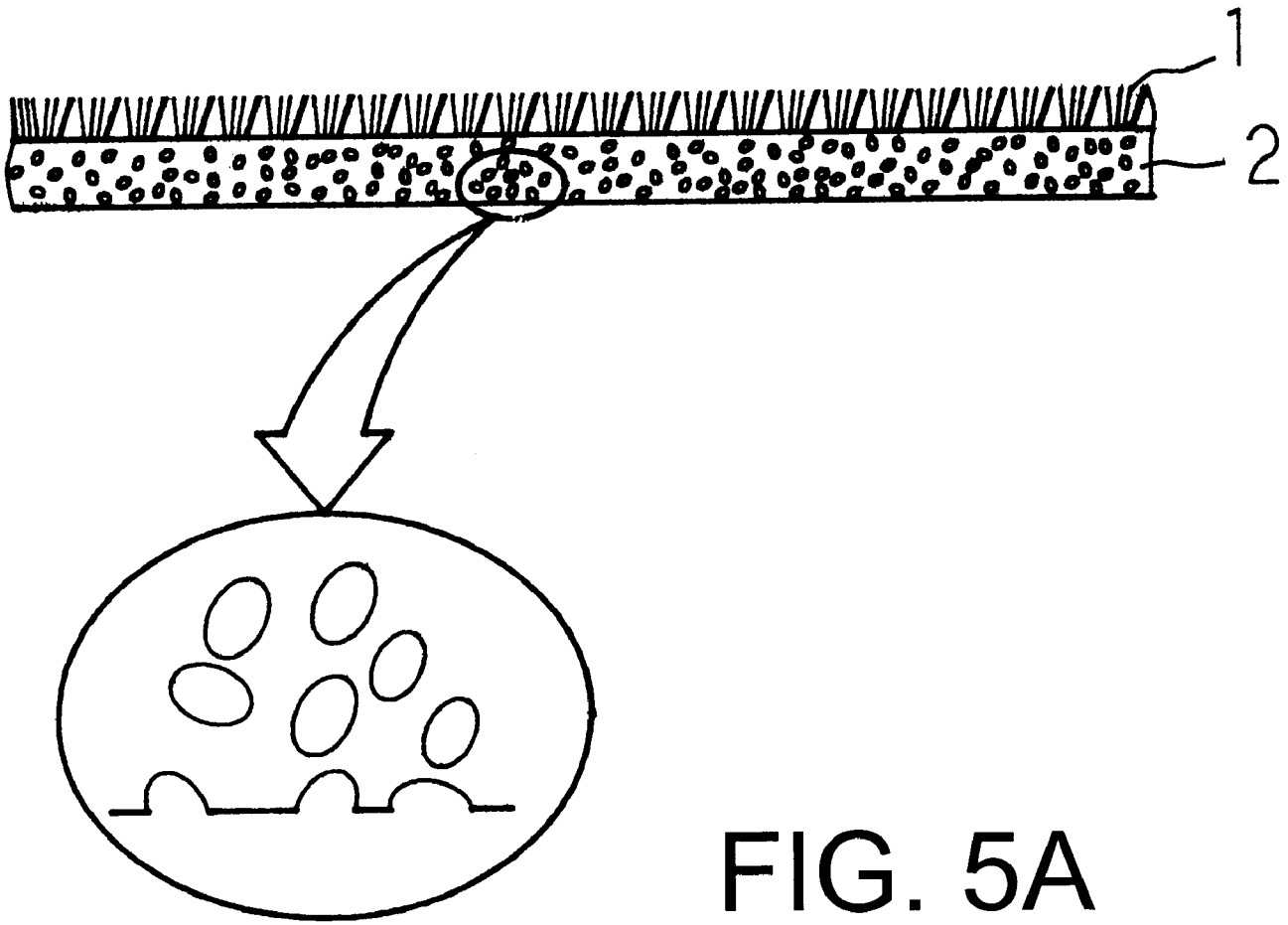
FIG. 5A is a cross-sectional view of the cover of FIG. 5.

FIG. 5A shows the mount layer 2 with the pores throughout as produced by the foaming agent used in the composition and the layer 1 of fabric.

In the case where the mount layer 2 is applied to the sheet 1, the composition of the mount layer 2 shown in TABLE-1 is blended and caused to foam by means of a mixer. Subsequently, the foamed composition is applied to one surface of the sheet 1 with the use of a coating apparatus. Then, the sheet 1 is put in a dryer and dried thereat at temperature of 120 to 160° C. for 5 minutes.

At this time, a physical properties test is conducted for the mount layers 2 which are formed by changing the expansion ratio and thickness of the applied layer. The results of the physical properties test are shown in TABLE-2 below. It will be apparent from TABLE-2 that the smaller the expansion ratio, the more satisfactory the peel strength is. In addition, the greater the expansion ratio, the more satisfactory the adhesive strength is. Further, as the thickness of the applied layer becomes greater, any of the physical properties improves.

The expansion ratio and thickness can be determined in consideration of a balance of required performance from the results shown in TABLE-2.

TABLE 2

| EXPANSION RATIO (X) | THICK-NESS (μs) | LAYER PEEL STRENGTH (g/2cm) | CELLOPHANE TAPE PEEL STRENGTH | SURFACE FRICTION STRENGTH (times) | ADHESI-VE STR-ENGTH (g/2cm) |
|---|---|---|---|---|---|
| 2.5 | 125 | 320 | ○ | 30 | 7 |
| 2.5 | 250 | 460 | ○ | 50 | 7 |
| 2.5 | 500 | 460 | ○ | 100 | 12 |
| 3.0 | 125 | 260 | X | 15 | 20 |
| 3.0 | 250 | 350 | X | 40 | 20 |
| 3.0 | 500 | 400 | X | 35 | 20 |
| 3.0 | 1000 | 500 | X | 40 | 22 |

TABLE 2-continued

| EXPANSION RATIO (X) | THICK-NESS (μs) | LAYER PEEL STRENGTH (g/2cm) | CELLOPHANE TAPE PEEL STRENGTH | SURFACE FRICTION STRENGTH (times) | ADHESI-VE STR-ENGTH (g/2cm) |
|---|---|---|---|---|---|
| 3.5 | 125 | 200 | X | 5 | 20 |
| 3.5 | 250 | 230 | X | 5 | 20 |
| 3.5 | 500 | 250 | X | 20 | 25 |

Specifically, the results shown in TABLE-2 are measured in the following manners.

Layer Peel Strength

Sample Production: Adhesive (F-520 thickener) is applied to cotton fabric. The adhesive applied cotton fabric is adhered to a foam surface, heat treated, and cut into strips of the width of 2 cm.

Foam rupture strength is measured by means of autograph.

Cellophane Tape Peel Strength

A piece of cellophane tape (1.8 mm) is adhered to the foam surface with hand, and then peel it off the foam surface in a perpendicular direction in an instant. Then, it is checked whether the foam surface has been damaged after peeling. O indicates no damage while X indicates damage.

Surface Friction Strength

The foam surface is rubbed by a friction tester (flat 500 g). A number of rubs until the foam surface is damaged is measured.

Adhesive Strength

A foam sheet of the width of 2 cm is pressingly adhered to a glass plate. After one day, the right angle peel strength is measured.

In the case where the washing is repeated twenty times, no change was confirmed in the adhesive strength of the mount layer 2.

As described above, since this toilet seat cover is provided with the mount layer 2 having the large attaching strength due to the vacuum suction, it can be adhered to the toilet seat when placed thereon and slightly pressed thereagainst. Once adhered to the toilet seat, the toilet seat cover is not to fall off even when the toilet seat is held upright. Further, if load is applied to the sheet 1 when the toilet seat cover is adhered to the toilet seat, the toilet seat cover can be easily adhered to the toilet seat just by slightly pressing the toilet seat cover against the toilet seat. In addition, having the satisfactory peel strength, the toilet seat cover can be easily taken off the toilet seat with leaving no component on the toilet seat. Moreover, since this toilet seat cover requires no attachment member on the toilet seat, one can seat on the toilet seat comfortably. Furthermore, since this toilet seat cover is foldable into a smaller size, one can carry it with him when setting out on his travel or other occasions. Further, the toilet seat cover can be always kept clean and sanitary since no change is confirmed in the adhesive strength thereof even after it is washed repeatedly and it can be washed repeatedly each time it is smudged.

This embodiment is described with respect to a case where the unwoven fabric is used as a sheet 1. However, the invention is not limited to application to the unwoven fabric. It may be appropriate to use woven fabric such as knitted fabric and pile. Further, material for the fabric to be used may be selected from a wide range of those, such as natural fiber including cotton, synthetic fiber including nylon, and synthetic resin film including polyester film.

Next, a modification of the first embodiment will be described in which components shown in TABLE-3 below are blended to form the mount layer 2. The products used as components shown in TABLE-3 are same as those used as components shown in TABLE-1.

TABLE 3

| COMPONENT | WEIGHT PART |
|---|---|
| SYNTHETIC RESIN EMULSION | 100 |
| FOAMING AGENT | 10 |
| ASSISTANT (1) | 1 |
| ASSISTANT (2) | 2 |
| ASSISTANT (3) | 0.5 |
| CATALYST | 0.5 |

In the case where the mount layer 2 is applied to the sheet 1, the components of the mount layer 2 shown in TABLE-3 are blended and caused to foam 3.3 times as much by a foaming apparatus. Subsequently, the foamed composition is applied to one surface of the sheet 1 by means of a coating apparatus such as a knife coater. Then, the sheet 1 is put in a dryer, and dried thereat at a temperature of 120° C. for 5 minutes and at a temperature of 140° C. for 2 minutes.

Similarly to the above-mentioned embodiment, this modification provides a toilet seat cover having the satisfactory adhesion to the toilet seat.

It will be appreciated that, though unillustrated, the first embodiment is applicable to the U-shaped toilet seat as well if the mount layer is applied to a rear surface of a sheet configured substantially similar to the shape of an upper surface of the U-shaped toilet seat.

Second Embodiment

Figure 7:
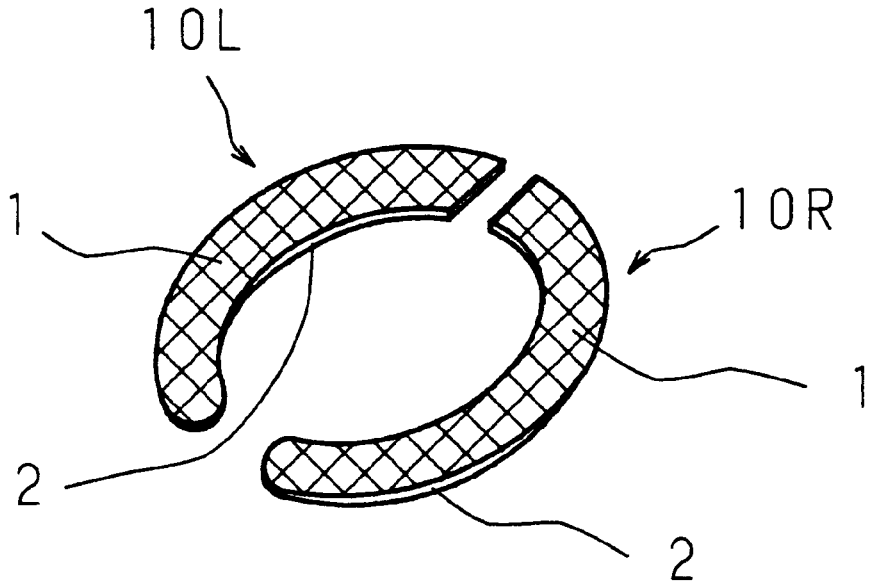
FIG. 7 is a perspective view of a toilet seat cover of a second embodiment of the invention.
Figure 8:
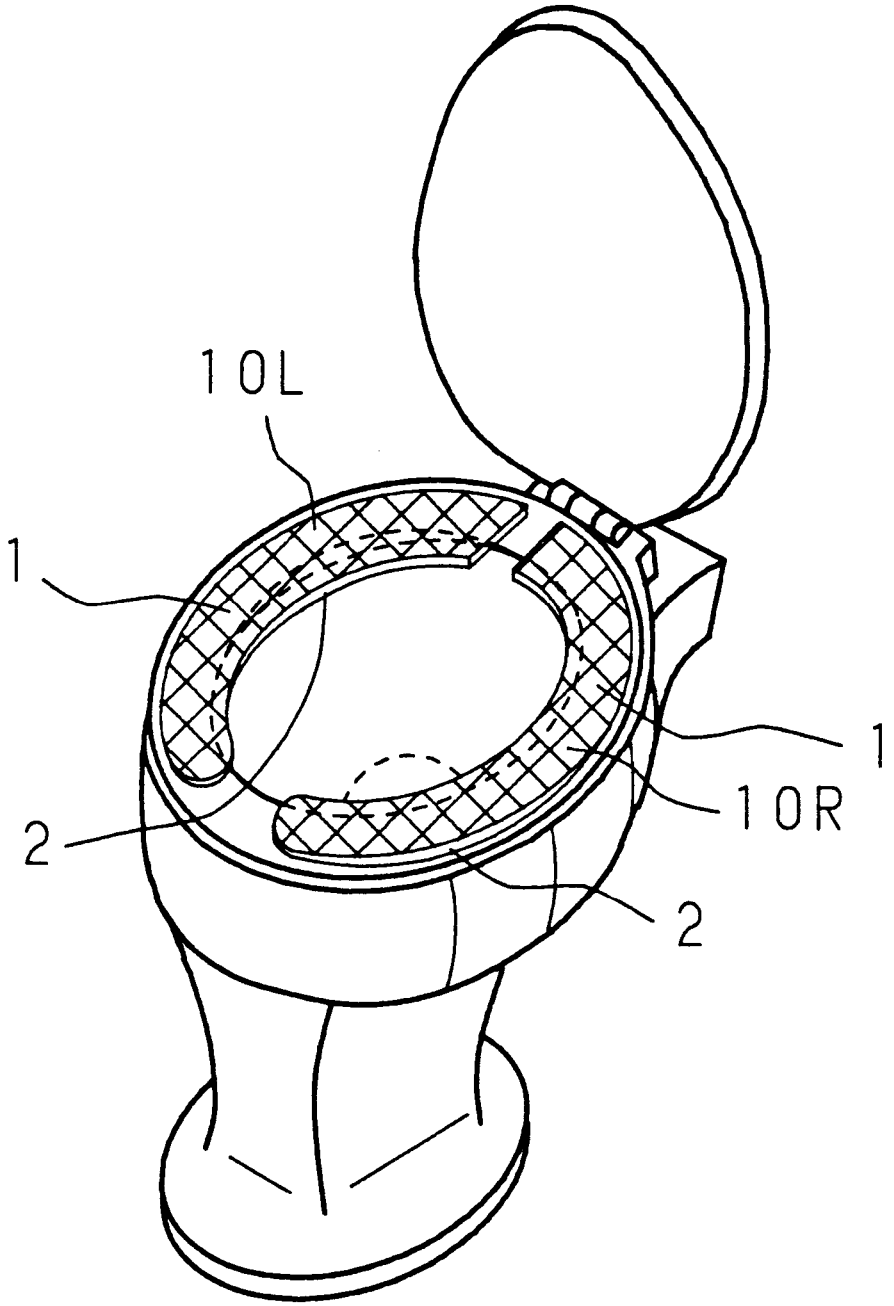
FIG. 8 is a perspective view showing an attached state of the toilet seat cover of the second embodiment.

FIG. 7 is a perspective view of a toilet seat cover as a second embodiment of the invention, and FIG. 8 is a perspective view showing an attached state of the toilet seat cover of the second embodiment. In these figures, indicated at 1 is a sheet made of unwoven fabric configured substantially identically to the shape of a portion of an upper surface of an O-shaped toilet seat. To a rear surface of the sheet 1 is applied a mount layer 2 obtained by mixing components shown in TABLE-1. The toilet seat cover of the second embodiment consists of a pair of laminated bodies 10L, 10R, each laminated body including the sheet 1 and the mount layer 2. In the first embodiment, the toilet seat cover is formed so as to cover an entirety of the upper surface of the toilet seat. However, in the second embodiment, the seat cover is formed so as to cover only a specified portion of the upper surface of the toilet seat. Thus, covering the toilet seat only partially, the toilet seat cover of the second embodiment is not required to have the shape thereof changed according to the shape of the toilet seat, i.e. between the O-shaped toilet seat and the U-shaped toilet seat. Therefore, this toilet seat cover is applicable to any type of toilet seats.

Third Embodiment

Both in the first and second embodiments, the mount layer 2 including"DICFOAM F-520," which is urethane synthetic resin, is used as synthetic resin. However, the synthetic resin which can be used in the invention is not limited to the above. As synthetic resin to be included in the mount layer 2 in order to obtain features of the toilet seat cover of the invention, there can be considered modacrylic adhesive, rubber adhesive, synthetic rubber, ethylene vinyl acetate alcohol (EVA), ethylene ethyl acrylate (EEA), ethylene methyl acrylate (EMA), urethane, etc. Physical properties (adhesion, heat resistance, washing endurance, and discoloration) of these types of resin were studied, and the results thereof are shown in TABLE-4 below.

TABLE 4

| RESIN MATERIAL | ADHE-SION | HEAT RESISTANCE | WASHING ENDURANCE | DISCOLO-RATION |
|---|---|---|---|---|
| MODACRYLIC ADHESIVE | ○ | ○ | X | ○ |
| RUBBER ADHESIVE | ○ | ○ | ○ | X |
| SYNTHETIC RUBBER | X | ○ | ○ | X |
| EVA | ○ | X | ○ | ○ |
| EEA | ○ | X | ○ | ○ |
| EMA | X | ○ | ○ | ○ |
| URETHANE | ○ | ○ | ○ | X |

○: satisfactory
X: bad

As will be seen from the results shown in TABLE-4, each of the resin materials has its merits and demerits. It is impossible to use only a certain type of resin. Accordingly, if, in order to take advantage of features of the respective types of resin, mixture obtained by selecting a plurality of types of resin from the above and mixing the same is used as material for the mount layer 2, such a mount layer 2 will demonstrate excellent results in the aforementioned physical properties.

In view of mixing readiness, cost effectiveness, and physical properties, it is optimum to use mixture of EVA and EMA. Hereafter, a description will be given with respect to a case where the mixture of EVA and EMA is used as material for the mount layer 2. TABLE-5 below shows measurement results of physical properties with respect to adhesive strength, heat resistance, and washing endurance in respective mixtures obtained by changing a mixing ratio of the EVA and EMA.

TABLE 5

| WEIGHT RATIO EVA/EMA | ADHESIVE STRENGTH | HEAT RESISTANCE | WASHING ENDURANCE |
|---|---|---|---|
| 100/0 | ○ | X | ○ |
| 90/10 | ○ | X | ○ |
| 80/20 | ○ | Δ | ○ |
| 70/30 | ○ | ○ | ○ |
| 60/40 | ○ | ○ | ○ |
| 50/50 | Δ | ○ | ○ |

○: satisfactory
Δ: normal
X: bad

If the vinyl acetate is contained 35% or more when only the EVA is used, the adhesion (initial adhesion) and washing endurance are satisfactory. However, in this case, the heat resistance is bad at a temperature of 40° C. On the other hand, when only the EMA is used, the heat resistance at the temperature of 40° C. is satisfactory. However, the initial adhesion is bad. It is seen from TABLE-5 that excellent physical properties can be obtained by adjusting the weight percentage of the EVA in a range 50 to 80% in the case where the mixture of the EVA and EMA is used as material for the mount layer of the toilet seat cover of the invention.

Next, the toilet seat cover of the invention was formed using the mixture of the EVA and EMA as material for the mount layer 2, and the physical properties of the formed toilet seat cover was measured. The measurement results will be described below. As EVA was used"EV-40LX" manufactured by Mitsui du Pont Ltd., and as EMA was used "XS-5508" manufactured by Exxon corporation. The weight ratio of EVA to EMA was set at 7:3. The obtained mixture was extruded by an extruder having a diameter of 90 mm into a layer of the thickness of 200 $\mu$m and applied to polyester tricot fabric, and thereby the toilet seat cover was formed as a prototype. Thus formed toilet seat cover was measured with respect to the following four points; a change in physical properties according to a temperature change, washing endurance, heat resistance, and change in adhesive strength over time. The size of the prototype was 25 mm (width)×10 cm. It was decided to apply the load by rolling a roll of 1 kg back and forth twice in attaching this prototype to the toilet seat. Hereafter, the respective physical properties will be described.

(1) Change in Physical Properties According to a Temperature Change

The temperature of the toilet seat to which the toilet seat cover formed as a prototype was attached was changed from 0 to 40° C., and the physical properties of the toilet seat cover were measured. The measurement results are shown in TABLE-6 below. The measurement was carried out in the following manner. This prototype was attached to the toilet seat, and the load was given by rolling the roll of 1 kg back and forth twice. Thereafter, the adhesive strength was measured after kept at respective temperatures for 30 minutes.

TABLE 6

| SEAT TEMPERATURE | 40° C. | 30° C. | 20° C. | 6° C. | 0° C. |
|---|---|---|---|---|---|
| ADHESIVE STRENGTH (g/25 mm(width)) | 600 | 260 | 140 | 120 | 200 |
| RESIN ADHESION | NO | NO | NO | NO | NO |
| FALLING OFF OF TOILET SEAT COVER | NO | NO | NO | NO | NO |

In a temperature range of 0 to 40° C., which is a temperature range of daily use, there is confirmed neither resin adhesion nor falling off of the toilet seat cover and the adhesive strength is satisfactory.

(2) Washing Endurance

Also, the washing endurance of the prototype was measured. The measurement results are shown in TABLE-7 and TABLE-8. The measurement was carried out in the following manner. The prototype was washed in 30 liter of water and 25 g of neutral detergent pooled in a domestic washing machine for 10 minutes and washed by water for 10 minutes.

Thereafter, the water is discharged from the washing machine and the prototype was hot-air dried for 15 minutes at a temperature of 40° C. Then, the temperature was caused to fall to a room temperature (20° C.) and the prototype was attached to the toilet seat to measure the adhesive strength. The above procedure was repeated.

TABLE 7

| TOILET SEAT | ADHESIVE STRENGTH | RESIN ADHESION | FALL OFF |
|---|---|---|---|
| INITIAL | 140 g/25 mm (width) | NO | NO |
| WASHING (1) | 160 g/25 mm (width) | NO | NO |
| WASHING (3) | 150 g/25 mm (width) | NO | NO |
| WASHING (10) | 100 g/25 mm (width) | NO | NO |
| WASHING (20) | 50 g/25 mm (width) | NO | NO |
| WASHING (30) | 40 g/25 mm (width) | NO | NO |

*a number in a bracket indicates a number of washing done

TABLE 8

| BLOCKING BETWEEN RESIN SURFACES | ADHESIVE STRENGTH | PEELING OF RESIN |
|---|---|---|
| INITIAL | 320 g/25 mm (width) | NO |
| WASHING (1) | 200 g/25 mm (width) | NO |
| WASHING (3) | 190 g/25 mm (width) | NO |
| WASHING (10) | 220 g/25 mm (width) | NO |

*a number in a bracket indicates a number of washing done

From TABLE-7 and TABLE-8, it can be seen that the adhesion will not deteriorate very much even if washing is repeated.

(3) Heat Resistance

After the prototype was attached to the toilet seat, the temperature of the toilet seat is set at 40° C. and load of 30 kg is applied to the prototype. After kept in this state for 40 hours, the prototype was peeled off the toilet seat. It can be inferred that the prototype has the satisfactory heat resistance at the temperature of 40° C. since it was peeled leaving no resin adhered to the toilet seat.

(4) Change in Adhesive Strength over Time

After the prototype was attached to the toilet seat, deterioration in the adhesive strength and discoloration of the prototype were observed. The observation results are shown in TABLE-9 below.

TABLE 9

| | WHEN FORMED | 10 DAYS LATER | 1 MONTH LATER |
|---|---|---|---|
| KEPT INDOORS | 140 g/25 mm (width) | 140 g/25 mm (width) NO DISCOLORATION | 140 g/25 mm (width) NO DISCOLORATION |
| UNDER SUN | 140 g/25 mm (width) | 140 g/25 mm (width) NO DISCOLORATION | 140 g/25 mm (width) NO DISCOLORATION |

After lapse of one month, the adhesive strength was unvaried and no discoloration was confirmed. Accordingly, it can be inferred that the physical properties of the prototype will deteriorate little even if it is used over a long period.

Fourth Embodiment

Figure 9:
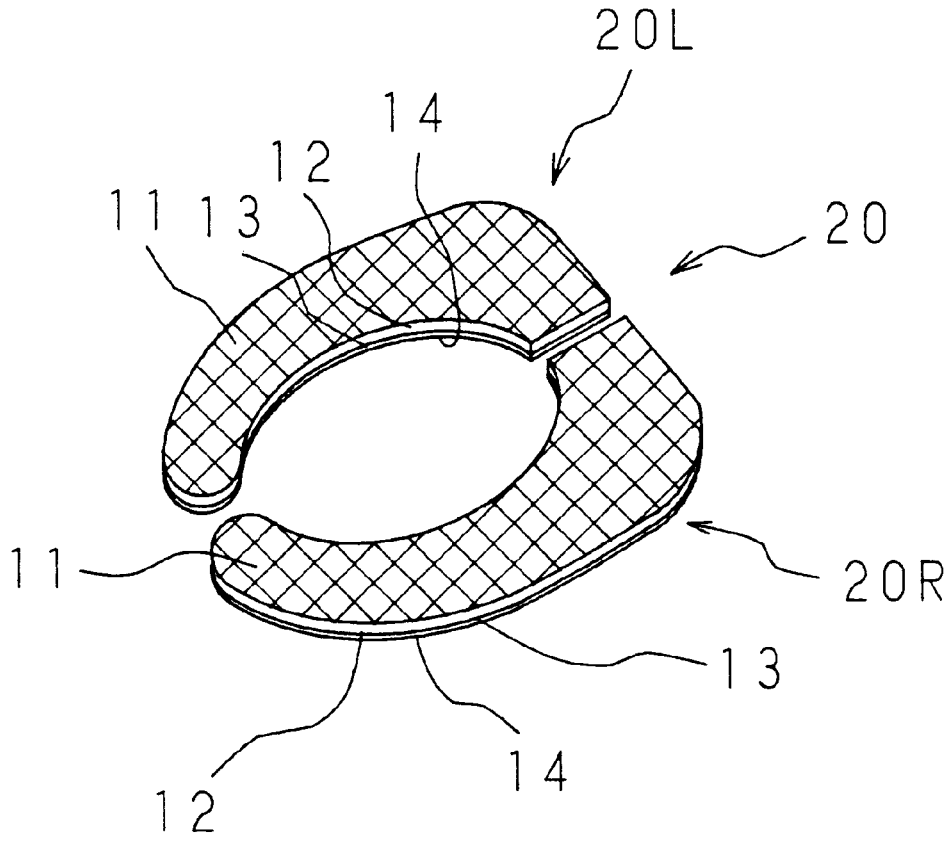
FIG. 9 is a perspective view showing a toilet seat cover as a fourth embodiment of the invention.
Figure 10:
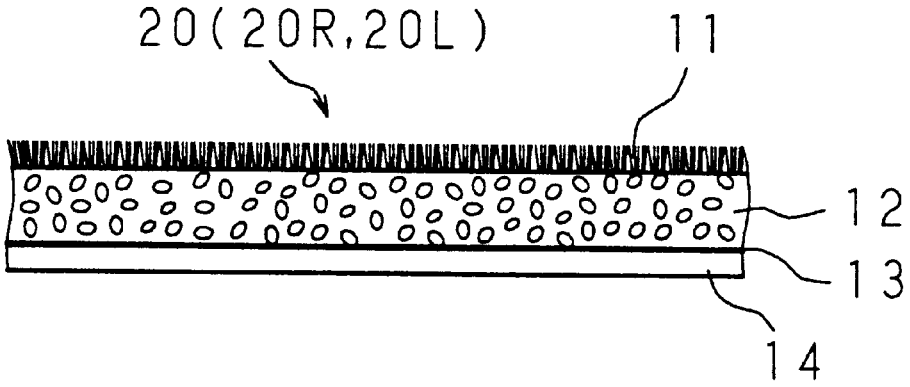
FIG. 10 is an enlarged sectional view of the toilet seat cover of the fourth embodiment.
Figure 11:
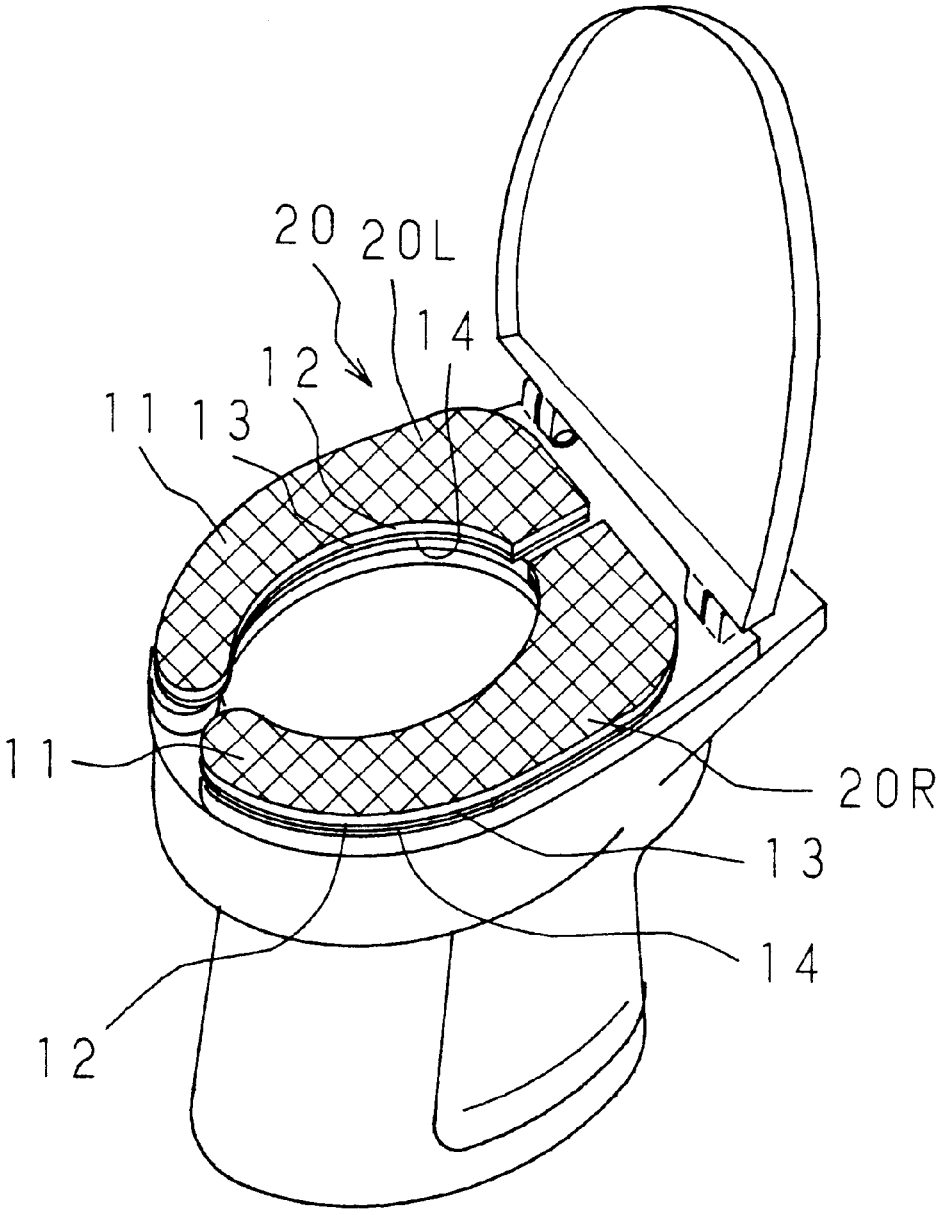
FIG. 11 is a perspective view showing an attached state of the toilet seat cover of the fourth embodiment.

FIG. 9 is a perspective view showing a toilet seat cover 20 as a fourth embodiment of the invention, FIG. 10 is an enlarged sectional view of the toilet seat cover 20, and FIG. 11 is a perspective view showing an attached state of the toilet seat cover 20.

The seat cover 20 has a shape corresponding to a configuration of a U-shaped toilet seat viewed from above. The toilet seat cover 20 is divided into two parts so as to meet the size difference, and thereby includes a right cover 20R and a left cover 20L. The toilet seat cover 20 (right cover 20R, left cover 20L) consists essentially of four layers; a fabric layer 11, porous buffer layer 12, permeation inhibitor layer 13 and mount layer 14 from above. The porous buffer layer 12 is made of, for example, foaming polyurethane, and has one surface thereof adhered to the fabric layer 11 by means of thermal fusion or with adhesive. To the other surface of the porous buffer layer 12 is adhered by means of thermal fusion or with adhesive the permeation inhibitor layer 13 being unwoven fabric, synthetic resin film, etc. It is sufficient for the permeation inhibitor layer 13 to have such a density as to prevent the material of the mount layer 14 from permeating the porous buffer layer 12.

The mount layer 14 is made of the material obtained by blending the components shown in TABLE-1, and same as the one used in the first and second embodiments. Also, a method for applying the mount layer 14 to the permeation inhibitor layer 13 is same as the one for applying the mount layer 2 to the sheet 1 which is described with reference to the first embodiment. Further, the expansion ratio and thickness of the mount layer 14 can be determined according to the results shown in TABLE-2 similarly to the first embodiment.

In the fourth embodiment as well, the toilet seat cover 20 (the mount layer 14) can be attached to the toilet seat by the vacuum suction force due to numerous pores formed in the mount layer 14. Also, the effect similar to the one described with reference to the first embodiment is obtainable.

Figure 12:
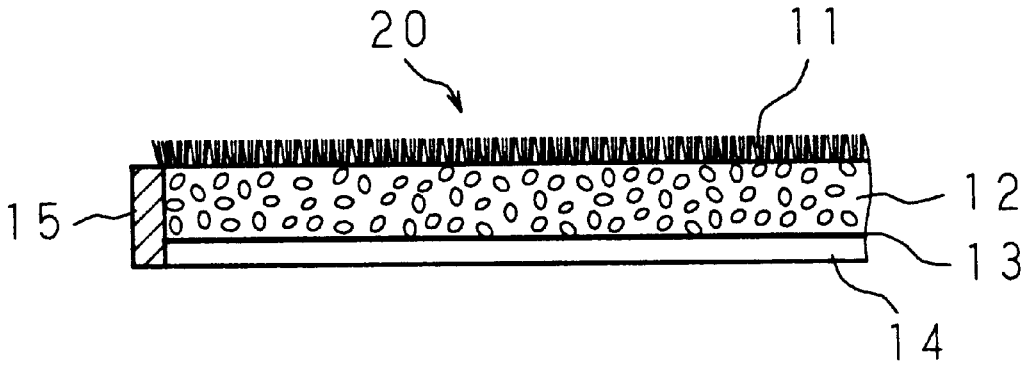
FIG. 12 is an enlarged sectional view of another toilet seat cover of the fourth embodiment.

In this embodiment, provision of the porous buffer layer 12 gives excellent seating and high heat insulation. Further, if an air inhibitor layer 15 is provided over a side circumferential surface of the porous buffer layer 12 for inhibiting the air from coming into and out of the porous buffer layer 12 as shown in FIG. 12, the heat retaining property can be further enhanced. Moreover, provision of the permeation inhibitor layer 13 eliminates the likelihood that the resin of the mount layer 14 permeates the porous buffer layer 12, thereby preventing material of the layer 14 from being wasted. In addition, the porous buffer layer 12 is unlikely to meet degradation in its function since the pores thereof are not to be blocked with the material permeated from the mount layer 14.

The toilet seat cover of the fourth embodiment may be dispensed with a fabric layer, and have the porous buffer layer 12 as an uppermost layer.

Though having the vacuum suction force in this embodiment, the mount layer 14 may be made of material having the adhesion as in the third embodiment.

Further, though this embodiment is described with respect to a case where it is attached to a U-shaped toilet seat, it goes without saying that this embodiment is applicable to an O-shaped toilet seat by covering a portion of an upper surface of the O-shaped toilet seat.

Fifth Embodiment

Figure 13:
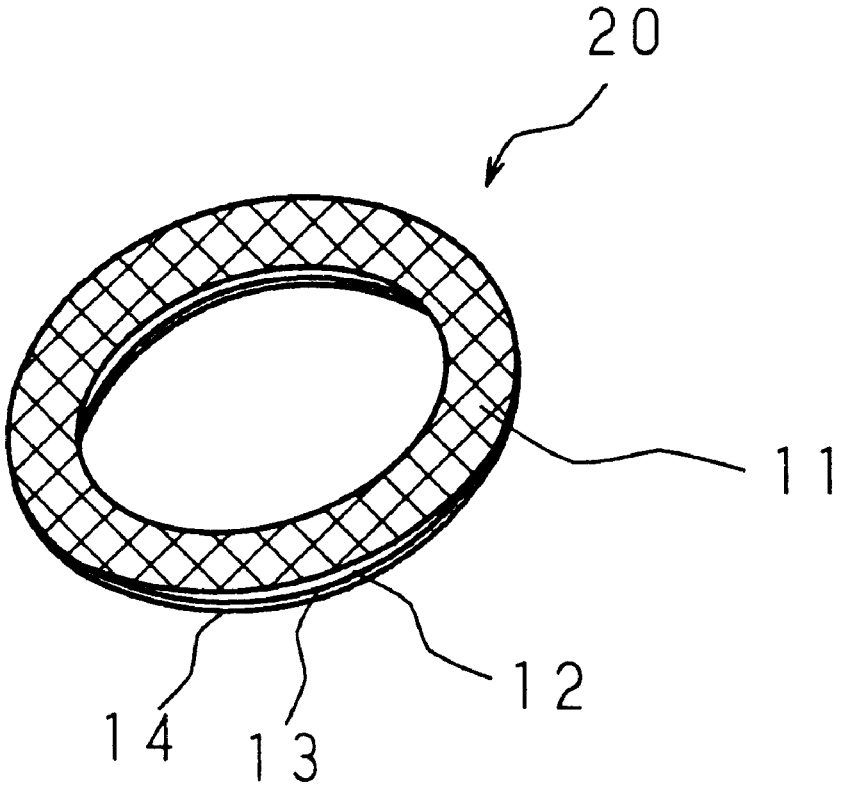
FIG. 13 is a perspective view of a toilet seat cover as a fifth embodiment of the invention.

FIG. 13 is a perspective view showing an attached state of a toilet seat cover 20 of a fifth embodiment. The toilet seat cover 20 shown in FIG. 13 has a four-layered structure similarly to the toilet seat cover 20 in the fourth embodiment, is formed in the shape of an annular strip, and is exclusively designed for an O-shaped toilet seat.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A toilet seat cover easily attachable to and removable from a toilet seat comprising:

a flexible and foldable flat sheet having a shape corresponding to the shape of at least part of an upper surface of the toilet seat, which sheet includes a flat mount layer of urethane synthetic resin material including a foaming agent, said mount layer having pores throughout and forming a mounting surface on one surface, the entirety of which mounting surface is adapted to contact and to attach said cover to the toilet seat upper surface, said mount layer attaching said sheet to said toilet seat by a vacuum suction force produced uniformly between said mounting surface and the seat by air discharged from the pores of said mount layer to reduce the pressure in the pores when the mount layer mounting surface is applied to the toilet seat, said cover being detachable from said seat by peeling the mount layer mounting surface from the seat.

2. A toilet seat cover as in claim 1 wherein said sheet further includes an unwoven fabric layer attached to and covering the surface of said mount layer opposite from the mount layer mounting surface.

3. A toilet seat cover as in claim 1 wherein said sheet further includes is a woven fabric layer attached to and covering the surface of said mount layer opposite from the mount layer mounting surface.

4. A toilet seat cover as in claim 1 wherein said sheet further includes another layer selected from a group consisting of natural fiber, synthetic fiber, and synthetic resin film layer attached to and covering the surface of said mount layer opposite from the mount layer mounting surface.

5. A toilet seat cover as in claim 1 wherein said sheet has the shape corresponding to a shape of an upper surface of a O-shaped toilet seat.

6. A toilet seat cover as in claim 1 wherein said sheet has the shape corresponding to a shape of an upper surface of a U-shaped toilet seat.

7. A toilet seat cover as defined in claim 1 wherein the material for said mount layer is mixture of ethylene vinyl acetate alcohol and ethylene methyl acrylate.

8. A toilet seat cover as defined in claim 7 wherein a weight percentage of ethylene vinyl acetate alcohol in the mixture lies in a range of from about 50 to about 80 percent.

9. A multi-layer toiler seat cover easily attachable to and removable from a toilet seat comprising:

a flexible and foldable flat sheet having a shape corresponding to the shape of at least a part of an upper surface of the toilet seat and including:

a porous buffer layer;

a mount layer of synthetic resin material including a foaming agent, said mount layer having pores throughout forming on one surface a mounting surface the entirety of which is adapted to contact and attach said cover to said toilet seat upper surface by a vacuum suction force produced uniformly between said mounting surface in contact with the seat upper surface by air discharged from the pores to reduce the pressure in the pores when said mounting surface of said mount layer is applied to the toilet seat upper surface;

a permeation inhibitor layer provided between and attached to said porous buffer layer and said mount layer to inhibit the material of said mount layer from permeating said porous buffer layer; and said cover being removable from the seat by peeling the mount layer mounting surface from the seat.

10. A multi-layer toilet seat cover as in claim 9 further comprising a fabric layer adhered over said porous buffer layer.

11. A toilet seat cover as in claim 9 wherein said porous buffer layer is made of foaming polyurethane.

12. A toilet seat cover as in claim 9 wherein said permeation inhibitor layer is one selected from the group consisting of unwoven fabric and synthetic resin film.

13. A toilet seat cover as in claim 9 wherein said toilet seat cover has a shape corresponding to a shape of an O-shaped toilet seat.

14. A toilet seat cover as in claim 9 wherein said toilet seat cover has a shape corresponding to a shape of a U-shaped toilet seat.

15. A toilet seat cover as in claim 9 further comprising a layer provided on a side circumferential surface of said porous buffer layer for inhibiting air from coming into and out of said porous buffer layer.

16. A toilet seat cover as in claim 1 wherein said cover further includes a layer of fabric material attached to the surface of said mount layer remote from the mounting surface attached to the toilet seat.

* * * * *